US006411028B1

(12) United States Patent
Chigusa et al.

(10) Patent No.: US 6,411,028 B1
(45) Date of Patent: Jun. 25, 2002

(54) CONDUCTIVE ANTI-REFLECTION FILM AND CATHODE RAY TUBE

(75) Inventors: Hisashi Chigusa, Urawa; Michiyo Abe, Tomioka; Hedemi Matsuda, Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/110,962

(22) Filed: Jul. 7, 1998

(30) Foreign Application Priority Data

Jul. 8, 1997 (JP) ..... 9-182812

(51) Int. Cl.[7] ..... H01J 29/10; H01J 31/00; H01J 5/16; H01J 61/40

(52) U.S. Cl. ..... 313/479; 461/466; 461/473; 461/477 R; 461/110; 461/112

(58) Field of Search ..... 313/461, 466, 313/473, 474, 477 R, 479, 480, 110, 112

(56) References Cited

U.S. PATENT DOCUMENTS 4,785,217 A * 11/1988 Matsuda et al. ..... 313/479
5,153,481 A 10/1992 Matsuda et al.
5,218,268 A 6/1993 Matsuda et al.
5,243,255 A 9/1993 Iwasaki
5,346,721 A 9/1994 Tong et al.
5,412,278 A 5/1995 Iwasaki
5,444,329 A * 8/1995 Matsuda et al. ..... 313/479

FOREIGN PATENT DOCUMENTS

| | | |
|---|---|---|
| JP | 61-118932 | 6/1986 |
| JP | 61-118946 | 6/1986 |
| JP | 63-160140 | 7/1988 |
| JP | 1-242769 | 9/1989 |
| JP | 4-345737 | 12/1992 |
| JP | 5-343007 | 12/1993 |
| JP | 7-282745 | 10/1995 |
| JP | 9-76401 | 3/1997 |

* cited by examiner

*Primary Examiner*—Vip Patel
*Assistant Examiner*—Mack Haynes
(74) *Attorney, Agent, or Firm*—Finnegan, Henderson, Farabow, Garrett & Dunner, L.L.P.

(57) ABSTRACT

A conductive anti-reflection film is disclosed, that comprises a first layer containing first conductive particles and a second layer disposed for covering the first layer, the second layer containing $SiO_2$ and second conductive particles. A conductive anti-reflection film prevents the AEF (Alternating Electric Field) from taking place and light from reflecting and allows the front surface to be conductive. In addition, the conductive anti-reflection film has high productivity and high durability. A cathode ray tube displays a high quality picture for a long service life.

7 Claims, 2 Drawing Sheets

CONDUCTIVE ANTI-REFLECTION FILM AND CATHODE RAY TUBE

BACKGROUND OF THE INVENTION

1. Field of the Invention

The present invention relates to a conductive anti-reflection film that functions as an anti-reflection film and prevents AEF (Alternative Electric Field) from taking place and to a cathode ray tube that suppresses light from reflecting on an outer surface of a face panel and thereby prevents the AEF from taking place.

2. Description of the Related Art

An electron gun and a deflection yoke of a cathode ray tube such as a TV Braun tube, a computer monitor, or the like generate electromagnetic waves.

So far, the possibility of which electromagnetic waves that leak out from a cathode ray tube adversely affects adjacent electronic devices has been pointed out.

To prevent the electromagnetic waves (electric field) of a cathode ray tube from leaking out, a method for decreasing the surface resistance of the face panel of the cathode ray tube has been proposed.

For example, Japanese Patent Laid-Open Application Nos. 61-118932, 61-118946, and 63-160140 disclose various surface treatment methods for preventing a face panel from being charged. With these methods, the AEF has been prevented. As methods for forming a conductive layer with a low surface resistance on a face panel, gas phase methods such as PVD method, CVD method, and spattering are known. For example, Japanese Patent Laid-Open Application No. 1-242769 discloses a method for forming a transparent low-resistance conductive layer using spattering method.

Generally, the refractive index of a conductive layer is high. Thus, it is difficult to have a sufficient anti-reflection effect with only a conductive layer. Consequently, to satisfy both properties of conductivity and anti-reflection and to protect a conductive layer, the conductive layer of the conductive anti-reflection film is covered with an anti-reflection layer containing $SiO_2$ and having a low refractive index. However, the surface resistance of the anti-reflection layer that contains $SiO_2$ and has a low refractive index is high. When the conductive layer is covered with the anti-reflection layer, the anti-reflection layer does not have conductivity.

To allow an anti-reflection layer of a cathode ray tube to be conductive, the following structures have been proposed.

(1) To allow a conductive layer 3 that structures a conductive anti-reflection film 2 formed on a face panel 8 to be conductive, a conductor portion 5 that pierces the anti-reflection layer 4 and contacts the conductor layer 3 is formed. Thereafter, the conductor portion 5 is filled with a special solder 6 (see FIG. 2).

(2) An area for a conductor portion 5 is formed in a conductor layer 3. An anti-reflection layer 4 is not formed in the conductor portion 5 (see FIG. 3).

(3) An anti-reflection layer 4 that is a porous layer is covered on a conductive layer 3. A part of the conductive layer 3 is exposed as a conductive portion.

However, when a conductive portion that pierces an anti-reflection layer is formed so as to allow a conductive anti-reflection film to be conductive and the conductive portion is filled with solder, the structure of the conductive anti-reflection film becomes complicated. In addition, since the number of fabrication steps increases, the productivity of the conductive anti-reflection film decreases.

On the other hand, when a conductive layer is covered with an anti-reflection layer that is a porous layer, the strength of the anti-reflection layer decreases. Thus, the durability of the conductive anti-reflection film remarkably decreases.

As a method for forming a conductive layer on a substrate such as a face panel, a solution of which conductive oxide particles or metal particles have been dispersed is coated on a substrate by coating method or wetting method. The resultant coated film is dried or baked and thereby a conductive layer is obtained.

In this method, a plurality of layers are formed on the substrate in such a manner that the refractive index of an inner layer of (adjacent to) the substrate is higher than the refractive index of an outer layer of (apart from) the substrate. In other words, the refractive index of the outermost layer is the lowest.

However, since the refractive index of a layer with higher conductivity is higher than the refractive index of a layer with lower conductivity, when a conductive layer is formed as an outermost layer disposed against the substrate, the characteristic for protecting the conductive anti-reflection film from reflecting light deteriorates or vanishes.

An anti-reflection layer that contains $SiO_2$ and that has a low refractive index is formed on a conductive layer so as to prevent light from reflecting. In this case, the anti-reflection layer functions as a capacitor. Thus, the surface resistance of the conductive anti-reflection film cannot be sufficiently decreased. Consequently, a conductive portion cannot be formed on the front surface of the conductive anti-reflection film.

SUMMARY OF THE INVENTION

An object of the present invention is to provide a conductive anti-reflection film that completely prevents the AEF (Alternating Electric Field) from taking place and light from reflecting and, allows the front surface thereof to be conductive, and has high productivity and durability.

Another object of the present invention is to provide a cathode ray tube that has such a conductive anti-reflection film and that can displays a high quality picture for a long service life.

According to the present invention, a layer of the front surface (an outermost layer against the substrate) of a conductive anti-reflection film contains $SiO_2$ and conductive particles so as to allow the front surface thereof to be conductive. Thus, a conductive portion can be easily formed on the front surface of the conductive anti-reflection film.

A first aspect of the present invention is a conductive anti-reflection film, comprising a first layer containing first conductive particles, and a second layer disposed for covering the first layer, the second layer containing $SiO_2$ and second conductive particles.

According to the conductive anti-reflection film of the present invention, the first layer containing conductive particles is covered with the second layer containing $SiO_2$ and conductive particles. Thus, the refractive index of the second layer becomes smaller than the refractive index of the first layer. In addition, the surface resistance of the second layer can be decreased. Thus, the second layer prevents light from reflecting. In addition, a conductive portion can be disposed on the second layer.

A second aspect of the present invention is a cathode ray tube, comprising a face plate having a first surface containing a phosphor substance, a first layer disposed on a second surface opposite to the first surface of the face plate, the first layer containing first conductive particles, and a second layer disposed for covering the first layer, the second layer containing $SiO_2$ and second conductive particles.

According to the cathode ray tube of the present invention, the first layer containing conductive particles is disposed on the second surface opposite to the first surface containing a phosphor substance. The first layer is covered with the second layer containing $SiO_2$ and conductive particles. Thus, the refractive index of the second layer becomes smaller than the refractive index of the first layer. In addition, the surface resistance of the second layer can be decreased. Consequently, the second layer can prevent light from reflecting and electrically contact with desired conductivity.

The conductive particles contained in the first layer may be the same as or different from the conductive particles contained in the second layer.

Examples of the conductive particles used in the present invention are super fine particles of at least one substance selected from the group consisting of gold, silver, silver compound, copper, copper compound, tin compound, and titanium compound. Examples of the silver compound are silver oxide, sliver nitrate, silver acetate, silver benzoic acid, silver bromate, silver bromide, silver carbonate, silver chloride, silver chromate, silver citric acid, and silver cyclohexane butyric acid. To allow the silver compound to be more stably present in the first layer and the second layer, preferable examples of the silver compound are Ag—Pd, Ag—Pt, and Ag—Au. Examples of the copper compound are copper sulfate, copper nitrate, and copper phthalocyanine. Examples of the tin compound are ATO and ITO such as $Sb_xSn_{1-x}O_2$ and $In_xSn_{1-x}O_2$. An example of the titanium compound is TiN.

The conductive particles are those of at least one of the above-described substances.

The larger the diameter of conductive particles, the higher the conductivity. However, to improve the optical characteristics of the conductive anti-reflection film, the diameter of the particles is preferably 400 nm or less, more preferably, 50 to 200 nm (in this case, the diameter of particles represents the diameter of a sphere with the same volume of each particle). When the diameter of the conductive particles exceeds 400 nm, the transmissivity of light of the conductive anti-reflection film remarkably deteriorates. In addition, since the particles cause light to scatter, the conductive anti-reflection film gets dimmed. On the other hand, when a conductive anti-reflection film containing conductive particles whose diameter exceeds 400 nm is used for a cathode ray tube, the resolution thereof may deteriorate.

The content of the conductive particles contained in the second layer is in the range from 5 to 50 wt %, more preferably, in the range from 10 to 40 wt % to the content of $SiO_2$ (namely, conductive particles (wt)/$SiO_2$ (wt)×100). When the content of the conductive particles contained in the second layer is 5 wt % or less to the content of $SiO_2$, the surface resistance of the second layer may not be a low resistance value that allows the second layer to be conductive as the front surface of the conductive anti-reflection film.

When the content of the conductive particles contained in the second layer exceeds 50 wt % to the content of $SiO_2$, the reflectivity of light of the conductive anti-reflection film becomes high. Thus, the conductive anti-reflection film may not sufficiently protect light from reflecting.

In addition, according to the present invention, to improve the optical characteristic of the conductive anti-reflection film, super fine particles of a pigment made of such as copper phthalocyanine may be contained in the first layer. At this point, the diameter of super fine particles is in the range from 10 to 200 nm (in this case, the diameter of particles represents the diameter of a sphere with the same volume of each particle). In addition, to improve the water resistance, chemical resistance, and so forth of the second layer and thereby improve the reliability of the conductive anti-reflection film, at least one of compounds such as $ZrO_2$, silane fluoride, and silicate may be contained corresponding to the environmental conditions. Such a compound is contained in the second layer in such a manner that the compound does not adversely affect the characteristic of the conductive anti-reflection film. When $ZrO_2$ is contained in the second layer, the content of $ZrO_2$ is in the range from 5 to 40 mole %, more preferably, in the range from 10 to 20 mole % to the content of $SiO_2$ (namely, $ZrO_2$ (mole)/$SiO_2$ (mole)×100. When the content of $ZrO_2$ in the second layer is 5 mole % or less to the content of $SiO_2$, the effect of $ZrO_2$ cannot be almost obtained. On the other hand, when the content of $ZrO_2$ contained in the second layer exceeds 40 mole % to the content of $SiO_2$, the strength of the second layer deteriorates. In addition, as described above, $ZrO_2$ may be contained in the second layer along with silane fluoride. In this case, the front surface of the conductive anti-reflection film can have desired conductivity. In addition, the water resistance, acid resistance, alkali resistance, and so forth of the conductive anti-reflection film can be further improved.

According to the present invention, to form the first layer, a solution in which particles of Au, Cu, or the like have been dispersed along with a non-ion interface activating agent is coated on a substrate that is the outer surface of a face panel of a cathode ray tube by for example spin coating method, spraying method, or dipping method. At this point, to further suppress the first layer from becoming uneven, the temperature of the surface of the substrate is preferably in the range from 5 to 60° C. The thickness of the first layer can be easily controlled by adjusting the concentration of metal particles of Ag and Cu, the number of rotations of a coater used in the spin coating method, the discharging amount of a dispersion solution in the spraying method, and the raising speed in the dipping method. As a solvent of the solution, when necessary, ethanol, IPA, or the like may be contained along with water. In addition, an organic metal compound, a pigment, a dye, or the like may be contained in the solution so as to add another characteristic to the first layer.

As a method for forming the second layer on the first layer, a solution in which particles of Au, Cu, or the like have been dispersed along with a non-ion interface activating agent is coated on the first layer by for example spin coating method, spraying method, or dipping method. The thickness of the second layer can be easily controlled by adjusting the concentration of metal particles of Ag, Cu, silicate, or the like, the number of rotations of a coater used in the spin coating method, the discharging amount of a dispersion solution in the spraying method, and the raising speed in the dipping method. By simultaneously baking the first coated film and the second coating film at a temperature from 150 to 450° C. for 10 to 180 minutes, the conductive anti-reflection film according to the present invention can be obtained. In addition, according to the present invention, to effectively decrease the reflectivity of the conductive anti-reflection film, a third layer may be disposed between the first layer and the second layer, the reflectivity of the third layer being almost the middle of the reflectivity of the first layer and the reflectivity of the second layer. In other words, the conductive anti-reflection film may be composed of two or more layers. At this point, when the difference of the refractive indexes of two adjacent layers is small, the reflectivity of the conductive anti-reflection film can be effectively decreased. According to the present invention, when the conductive anti-reflection film is composed of the first layer and the second layer, the thickness and refractive index of the first layer is 200 nm or less and 1.7 to 3, respectively. The thickness and refractive index of the second layer is 10 times or less and 1.38 to 1.70 times as large as those of the first layer, respectively. When the third layer is disposed between the first layer and the second layer, the thickness and refractive index of each of the first to third layers depend on the transmissivity and refractive index of the conductive anti-reflection film.

These and other objects, features and advantages of the present invention will become more apparent in light of the following detailed description of a best mode embodiment thereof, as illustrated in the accompanying drawings.

BRIEF DESCRIPTION OF THE INVENTION

DESCRIPTION OF PREFERRED EMBODIMENTS

Next, with reference to the accompanying drawings, embodiments of the present invention will be described. It should be noted that the present invention is not limited to the embodiments that follow.

Particles of ITO were dispersed in ethanol. Thus, a dispersed solution of 2 wt % of ITO was obtained. Particles of ITO were added and mixed to a solution of 1 wt % of silicate a solution of mixed composition of trimer and tetramer of tetramethoxysilane (the degree of polymerization is 3.5 (average)) so that the solid component of $SiO_2$ to the solution of 1 wt % of silicate becomes 0 wt % (comparative example), 5, 10, 20, 40, 50, and 100 wt % (first to sixth embodiments). Thus, second to sixth dispersed solutions were obtained. In this example, wt % represents ITO (wt)/$SiO_2$ (wt)×100.

Next, the outer surface of a face panel (17-inch panel) of a cathode ray tube that had been assembled was buffed with cerium oxide. After rubbish, dust, and oil were removed from the buffed surface, the first dispersed solution was coated on the buffed surface by the spin coating method. Thus, a first film was formed. The coating conditions of the first film were in the following conditions.

Panel temperature (coated surface): 30° C.

Number of rotations of coater in solution pouring stage: 80 rpm-5 sec

Number of rotations of coater in solution shaking stage (film forming stage) : 150 rpm-80 sec Next, the second to eighth solutions were coated on the first film by the spin coating method in the following conditions.

Number of rotations of coater in solution pouring stage: 80 rpm-5 sec

Number of rotations of coater in solution shaking stage: 150 rpm-80 sec

Thereafter, the first film and the second film were baked at a temperature of 210° C. for 30 minutes.

Figure 1A:
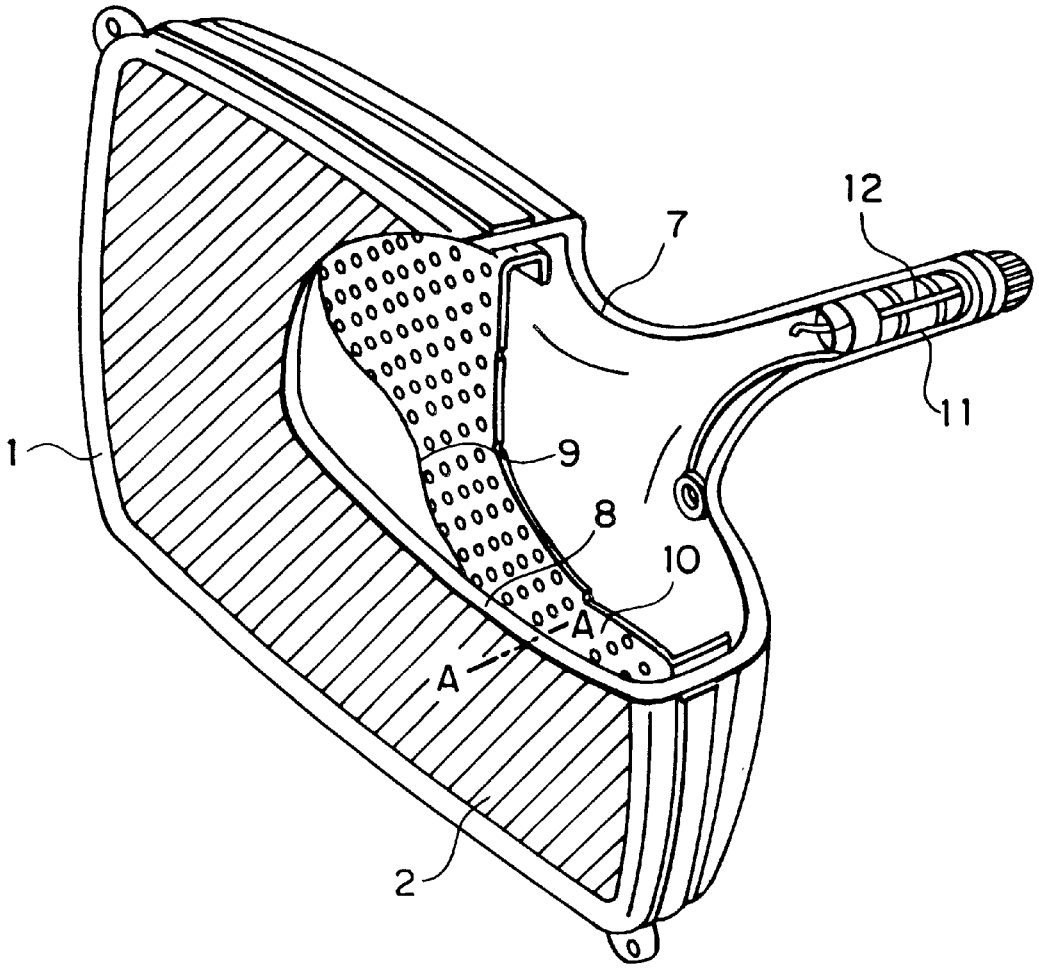
FIG. 1A is a perspective view showing the structure of a cathode ray tube according to the present invention.
Figure 1B:
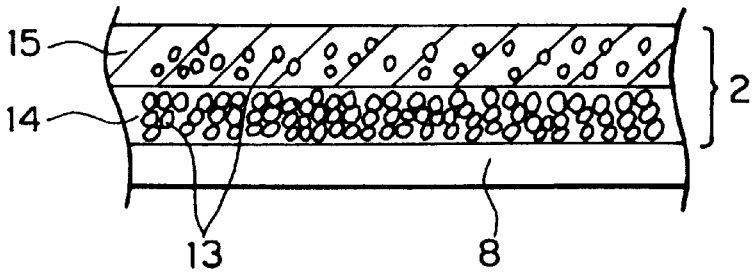
FIG. 1B is a sectional view taken along line A–A' of the cathode ray tube shown in FIG. 1A.
Figure 2:
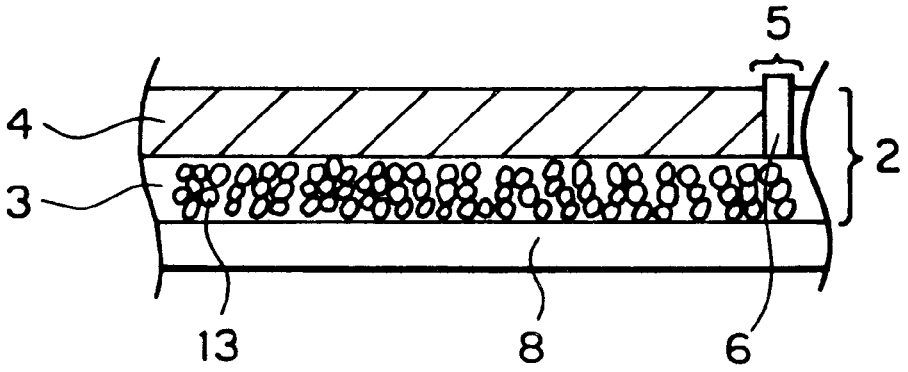
FIG. 2 is a sectional view showing the structure of a conductive anti-reflection film of a conventional cathode ray tube.
Figure 3:
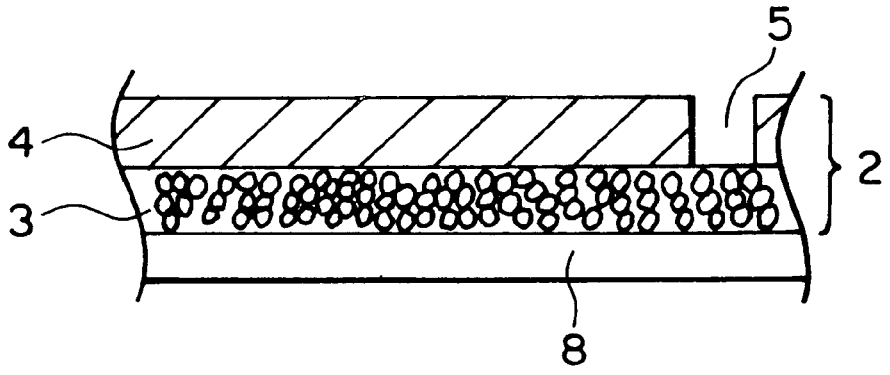
FIG. 3 is a sectional view showing the structure of a conductive anti-reflection film of a conventional cathode ray tube.
Figure 4:
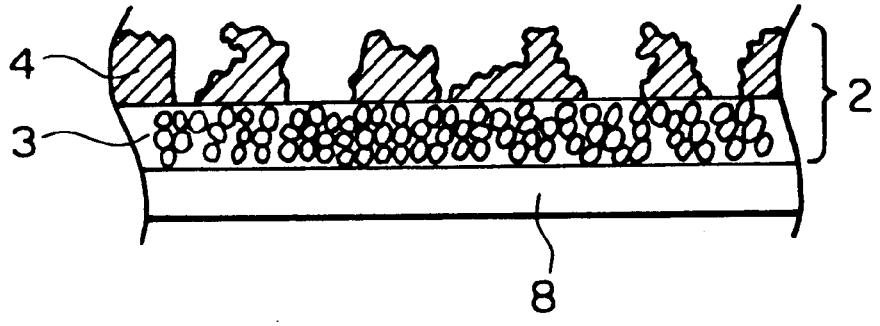
FIG. 4 is a sectional view showing the structure of a conductive anti-reflection film of a conventional cathode ray tube.

FIGS. 1A and 1B show a cathode ray tube according to the first to sixth embodiments of the present invention.

In FIG. 1A, a color cathode ray tube has a panel 1 and an enclosure. The enclosure is composed of a funnel integrally connected to the panel 1. Inside a face panel 8 assembled to the panel 1, a phosphor surface 9 is formed. The phosphor surface 9 is composed of a three-color phosphor layer and a black-light-absorbing layer. The three-color phosphor layer emits rays of blue, green, and red. The black light absorbing layer is disposed in the space of the three-color phosphor layer. The three-color phosphor layer is obtained in a conventional method for example by coating a slurry of which each color phosphor has been dispersed in PVA, surface activating agent, and demineralized water on the inner surface of the face panel 8. The three-color phosphor layer may be formed in a stripe shape or in a dot shape. In this example, the three-color phosphor layer is formed in a dot shape. A shadow mask 10 having many electron beam holes is disposed opposite to the phosphor surface 9. An electron gun 12 is disposed in a neck 11 of the funnel 7. The electron gun 12 emits an electron beam to the phosphor surface 8. The electron beam emitted from the electron gun 12 hits the phosphor surface 9 and thereby excites the three-color phosphor layer. Thus, rays of three colors are emitted. A conductive anti-reflection film 2 is formed on the outer surface of the face panel 8. FIG. 1B is a sectional view taken along line A–A' of the cathode ray tube shown in FIG. 1A. On the front surface of the face panel 8, the conductive anti-reflection film 2 is formed. The conductive anti-reflection film 2 is composed of a first layer (conductive layer) 14 and a second layer 15. The first layer 14 contains particles 13 of ITO. The second layer 15 is composed by dispersing particles 13 of ITO to a matrix of $SiO_2$.

For each of the conductive anti-reflection films obtained as the first to sixth embodiments and the comparative example, the surface resistance, the resistance stability, the film strength, and the visible regular reflectivity were measured. The surface resistance was measured with Loresta IP MCP-T250 (made by Yuka Denshi). With respect to the resistance stability, variations of measured values were examined (in Table 1, O represents absence of variation, whereas X represents presence of variation). With respect to the film strength, a probe composed of SUS 304 was contacted to each of the individual respective conductive anti-reflection films at a pressure of 1.5 kg/cm$^2$. Thereafter, with the pressure of 1.5 kg/cm$^2$ of the probe, each of the conductive anti-reflection films was moved. (In Table 1, a conductive anti-reflection film that was not scratched by the probe is denoted by O, whereas a conductive anti-reflection film that was scratched by the probe is denoted by X). The visible regular reflectivity was measured by CR-353G (made by Minoruta). Table 1 lists the measured results of the conductive anti-reflection films according to the compared example and the first to sixth embodiments.

TABLE 1

| | Comparative Example | First Embodiment | Second Embodiment | Third Embodiment | Fourth Embodiment | Fifth Embodiment | Sixth Embodiment |
|---|---|---|---|---|---|---|---|
| Added content of ITO (Ratio to $SiO_2$:wt %) | 0 | 5 | 10 | 20 | 40 | 50 | 100 |
| Surface resistance | 16–21 | 4 | 0.45 | 0.36 | 0.30 | 0.30 | 0.28 |
| Resistance stability | X | ○ | ○ | ○ | ○ | ○ | ○ |
| Film strength (scratch test) | ○ | ○ | ○ | ○ | ○ | ○ | X |
| Visible regular reflectivity | 1.4 | 1.5 | 1.6 | 1.7 | 2.0 | 2.5 | 3.0 |

As is clear from Table 1, since the front surface of each of the conductive anti-reflection films according to the first to sixth embodiments has conductivity, the surface resistance thereof is low and the resistance stability thereof is sufficient. In addition, the visible reflectivity is sufficient. On the other hand, since the second layer of the conductive anti-reflection film according to the compared example does not contain particles of ITO, the surface resistance is high and the resistance stability is insufficient. As a result, the front surface of the conductive anti-reflection film according to the compared example does not have conductivity.

In the sixth embodiment, although the film strength is denoted by X, the film strength of the conductive anti-reflection film is practically sufficient.

As is clear from the above-described embodiments, according to the conductive anti-reflection films of the present invention, the first layer containing the first conductive particles is covered with the second layer of which the second conductive particles are contained in the matrix of $SiO_2$. Thus, the refractive index of the second layer becomes smaller than the refractive index of the first layer. In addition, the surface resistance of the second layer can be decreased. Thus, a conductive anti-reflection film that prevents the AEF from taking place, that prevents light from reflecting on the second layer, and that allows the second layer to be conductive can be provided. In addition, since the conductive anti-reflection film is conductive, another conductive means is not required. Thus, the productivity of the conductive anti-reflection film is high. Moreover, since the stability of the second layer that covers the first layer is high, a conductive anti-reflection film with high durability can be provided.

In addition, according to a cathode ray tube of the present invention, since the first layer containing the first conductive particles is disposed on the surface of the face plate, the first layer is covered with the second layer containing $SiO_2$ and the second conductive particles. Thus, the refractive index of the second layer becomes smaller than the refractive index of the first layer. In addition, the surface resistance of the second layer can be decreased. Thus, a cathode ray tube that prevents the AEF (Alternating Electric Field) from taking place, that prevents light from reflecting on the second layer, and that allows the second layer to be stably conductive without need to form a conductive portion can be provided. In addition, with the conductive anti-reflection film, another conductive means is not required. Thus, a cathode ray tube with high productivity can be provided. In addition, since the stability of the second layer that covers the first layer is high, a cathode ray tube that can display a high quality picture for a long service life can be provided.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A conductive anti-reflection film, comprising:

a first layer disposed on a surface of a substrate, said first layer containing first conductive particles; and a second layer disposed for covering said first layer, said second layer containing $SiO_2$ and second conductive particles, wherein the content of the second conductive particles contained in said second layer is in the range from greater than 5 to 40 wt % to the total content of the second particles and $SiO_2$.

2. The conductive anti-reflection film as set forth in claim 1, wherein the first conductive particles and the second conductive particles are the same material or different materials selected from the group consisting of gold, silver, silver compound, copper, copper compound, tin compound, and titanium compound.

3. The conductive anti-reflection film as set forth in claims 1 or 2:

wherein the diameter of the first and second conductive particles is 400 nm or less, wherein the diameter of particles represents the diameter of a sphere with the same volume in each particle.

4. The conductive anti-reflection film as set forth in claim 1 or 2, wherein the content of the second conductive particles contained in said second layer is in the range from 10 to 40 wt % to the total content of the second particles and $SiO_2$.

5. The conductive anti-reflection film as set forth in claim 1, wherein surface resistance of the first layer is less than about $4*10^4\Omega/\square$.

6. A cathode ray tube, comprising:

a face plate having a first surface containing a phosphor substance;

a first layer disposed on a second surface opposite to the first surface of said face plate, said first layer containing first conductive particles; and a second layer disposed for covering said first layer, said second layer containing $SiO_2$ and second conductive particles, wherein the content of the second conductive particles contained in said second layers is in the range from greater than 5 to 40 wt % to the content of the second particles and $SiO_2$.

7. The cathode ray tube as set forth in claim 6, wherein the first and second conductive particles are the same material or different materials selected from the group consisting of gold, silver, silver compound, copper, copper compound, tin compound, and titanium compound.

* * * * *

UNITED STATES PATENT AND TRADEMARK OFFICE

CERTIFICATE OF CORRECTION

PATENT NO. : 6,411,028 B1
DATED : June 25, 2002
INVENTOR(S) : Chigusa et al.

It is certified that error appears in the above-identified patent and that said Letters Patent is hereby corrected as shown below:

Title page,
Item [75], in the Inventors, change "Hedemi" to -- Hidemi --.

Column 8,
Line 58, after "to the" insert -- total --.

Signed and Sealed this

Twelfth Day of November, 2002

*Attest:*

*Attesting Officer*

JAMES E. ROGAN
*Director of the United States Patent and Trademark Office*